US006810839B2

(12) United States Patent
Gohou

(10) Patent No.: US 6,810,839 B2
(45) Date of Patent: Nov. 2, 2004

(54) CONTROL DEVICE FOR CONTROLLING CONTROL MOTOR OF INTERNAL COMBUSTION ENGINE

(75) Inventor: Manabu Gohou, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/270,372

(22) Filed: Oct. 15, 2002

(65) Prior Publication Data

US 2003/0150411 A1 Aug. 14, 2003

(30) Foreign Application Priority Data

Feb. 14, 2002 (JP) ..... 2002-036261

(51) Int. Cl.[7] ..... F02B 75/02
(52) U.S. Cl. ..... 123/65 PE; 123/323
(58) Field of Search ..... 123/65 PE, 323; 251/129.11

(56) References Cited

U.S. PATENT DOCUMENTS 4,793,347 A * 12/1988 Taniuchi et al. ..... 123/65 PE
5,502,963 A * 4/1996 Inaba ..... 123/65 PE
6,039,012 A * 3/2000 Motoyama ..... 123/65 PE
6,227,922 B1 * 5/2001 Ochiai ..... 123/65 PE
6,481,394 B1 * 11/2002 Hiki ..... 123/65 PE
6,508,214 B1 * 1/2003 Uchida ..... 123/65 PE
6,591,606 B2 * 7/2003 Rosskamp et al. ..... 123/65 PE
6,622,671 B2 * 9/2003 Uchida ..... 123/65 PE
2003/0150412 A1 8/2003 Gohou

FOREIGN PATENT DOCUMENTS

JP 1-58739 U 4/1989
JP 8-23313 3/1996

OTHER PUBLICATIONS

Patent Abstracts of Japan, Publication No. 10–089099, Publication date: Apr. 07, 1998.
Patent Abstracts of Japan, Publication No. 2000–303915, Publication date: Oct. 31, 2000.

* cited by examiner

*Primary Examiner*—Henry C. Yuen
*Assistant Examiner*—Jason Benton
(74) *Attorney, Agent, or Firm*—Sughrue Mion, PLLC

(57) ABSTRACT

The control device for a control motor of an engine has: a control information output unit for detecting an operational state of the engine as control information; target value computing unit for obtaining a target value of the motor corresponding to the control information; current value detecting unit for detecting a current value of the motor; motor control signal determining unit for generating a motor control signal for controlling a drive of the motor based on the target value and the current value; drive unit for driving the motor based on the motor control signal; and control state information determining unit for generating control state information indicating a change in the operational state of the engine based on a change in the control information. The target value computing unit corrects the control information based on the control state information so as to obtain a suitable target value.

14 Claims, 8 Drawing Sheets

CONTROL DEVICE FOR CONTROLLING CONTROL MOTOR OF INTERNAL COMBUSTION ENGINE

BACKGROUND OF THE INVENTION

1. Field of the Invention

The present invention relates to a control device for a control motor of an internal combustion engine, and more particularly to a control device for a control motor of an internal combustion engine in which the control device causes the control motor to follow a target value obtained according to an engine operational state of the internal combustion engine.

2. Description of the Related Art

Since rpm changes and load changes in a vehicle engine are great, techniques have been known which detect an operational state of the engine and control the opening and closing of a variety of control valves to achieve the optimum control in response to the operational state of the engine. For example, JP 62-126222 A describes a technique in which an exhaust control valve is provided near an open end on the downstream side of an exhaust pipe, and output increase is achieved by fully opening the control valve when the engine is in a high speed region, to utilize a dynamic effect of an exhaust system to a maximum limit on the one hand, and closing the control valve to approximately a ½-opening degree to prevent the dynamic effect from operating in a reverse fashion in a medium speed region where a torque valley would be generated. A variety of proposals have also been proposed in which a control valve is provided to an interconnecting pipe connecting a plurality of intake pipes, and the control valve is caused to open and close with the engine rpm to essentially change the length of the intake pipe.

As a method in which a motor controls the control valves to follow a target opening degree, FIG. 6 illustrates one example of a method in which the target opening degree is computed based on control information, a stop target area is set around the target opening degree, and a current opening degree and the stop target area are compared against each other, to thereby control output of a motor control signal. FIG. 7 is a flow chart showing a flow of processing according to this method.

In FIG. 6, reference numeral 100 indicates a target value computing means for computing a target value of an opening degree of the control valve (hereinafter, referred to as a target opening degree), reference numeral 101 indicates control information representing an operational state of an engine which is used in the computing of the target value by the target value computing means 100, reference numeral 102 indicates a target value computed by the target value computing means 100, and reference numeral 103 indicates a stop target area which is set to a given width in which the target value is at the center of the width.

As shown in the flow chart in FIG. 7, in accordance with this method, first, a variety of sensors are used to detect the operational state of the engine which serves as control information, and, from this control information, the target value computing means 100 computes the target opening degree for the control valve that is a subject of the control (step S101). Then, the current opening degree is computed (step S102), the stop target area is set around the computed target opening degree (step S103), and the current opening degree and the stop target area are compared (step S104). Accordingly, if the current value is within the stop target area, the current value is kept (step S105), and, if the current value is outside the stop target area, a control is performed to output a motor control signal so as to bring the current value closer to the target value (step S106).

As described above, in the conventional method in which the motor is used to control the control valve so that the control valve follows the target opening degree, the target opening degree is computed based on the control information indicating the engine's operational state. Therefore, when an operation is performed to keep uniformly the control information, in a case where the control information has a characteristic that it always fluctuates, like engine rpm for example even when the operation is performed to uniformly maintain the control information, a phenomenon may occur in which the control valve and the motor which manipulates the control valve vibrate. This phenomenon occurs in the case where there is an area where the changes in the control information cause an amount of change $\Delta\theta$ in the target opening degree to be greater than the width of the stop target area. This phenomenon occurs according to the sequence shown in FIG. 8.

In FIG. 8, reference numeral 103 refers to the stop target area and reference numeral 104 refers to the current value. Portion (1) of FIG. 8 illustrates a state in which the motor current is turned off. In this state, the target opening degree fluctuates by an amount equal to $\Delta\theta$. Along with this fluctuation, the stop target area 103 shifts in the forward rotational direction of the motor position by an amount equal to $\Delta\theta$, and enters the state shown in portion (2) of FIG. 8. In this state, the motor current flows so as to create a forward rotation, causing the current value 104 to shift in the forward rotational direction to enter the state shown in portion (3) of FIG. 8. In this state, another fluctuation in the control information causes the target opening degree to change, this time in the opposite rotational direction from the motor position, entering the state shown in portion (4) of FIG. 8. The motor current then flows to create a reverse directional rotation, thereby entering the state shown in portion (1) of FIG. 8. The above is performed repeatedly.

As described above, the setting of the target value and fluctuation of the control information that the target value is based on, work in a joint fashion, causing a phenomenon in which the motor vibrates. This phenomenon implies that a large starting current is flown to the motor again and again. Thus, there has been a problem in that the temperature of the motor increases excessively and the longevity of the motor is reduced.

SUMMARY OF THE INVENTION

The present invention has been made to solve the above-mentioned problems, and an object of the present invention is therefore to provide a control device for a control motor of an internal combustion engine, which is capable of alleviating vibration of the control motor.

The present invention relates to a control device for controlling a control motor of an internal combustion engine which follows a target value that changes in response to an operational state of the internal combustion engine, the control device comprising: control information output means for detecting the operational state of the internal combustion engine and turning it into control information; target value computing means for obtaining the target value of the control motor corresponding to the control information outputted from the control information output means; current value detecting means for detecting a current value of the control motor; motor control signal determining means for generating a motor control signal for controlling a drive of the control motor, based on the target value and on the current value; drive means for driving the control motor based on the motor control signal; and control state information determining means for generating control state information indicating a change in the operational state of the internal combustion engine, based on a change in the control information outputted from the control information output means; in which the target value computing means corrects the control information based on the control state information, and obtains the target value corresponding to the corrected control information.

Therefore, it can be recognized that the control state information performs the manipulation such that the control information is maintained uniformly and it is possible to alleviate the phenomenon in which the motor vibrates by correcting the control information that determines the target value with the control state information.

DETAILED DESCRIPTION OF THE PREFERRED EMBODIMENTS

Embodiment 1

Figure 1:
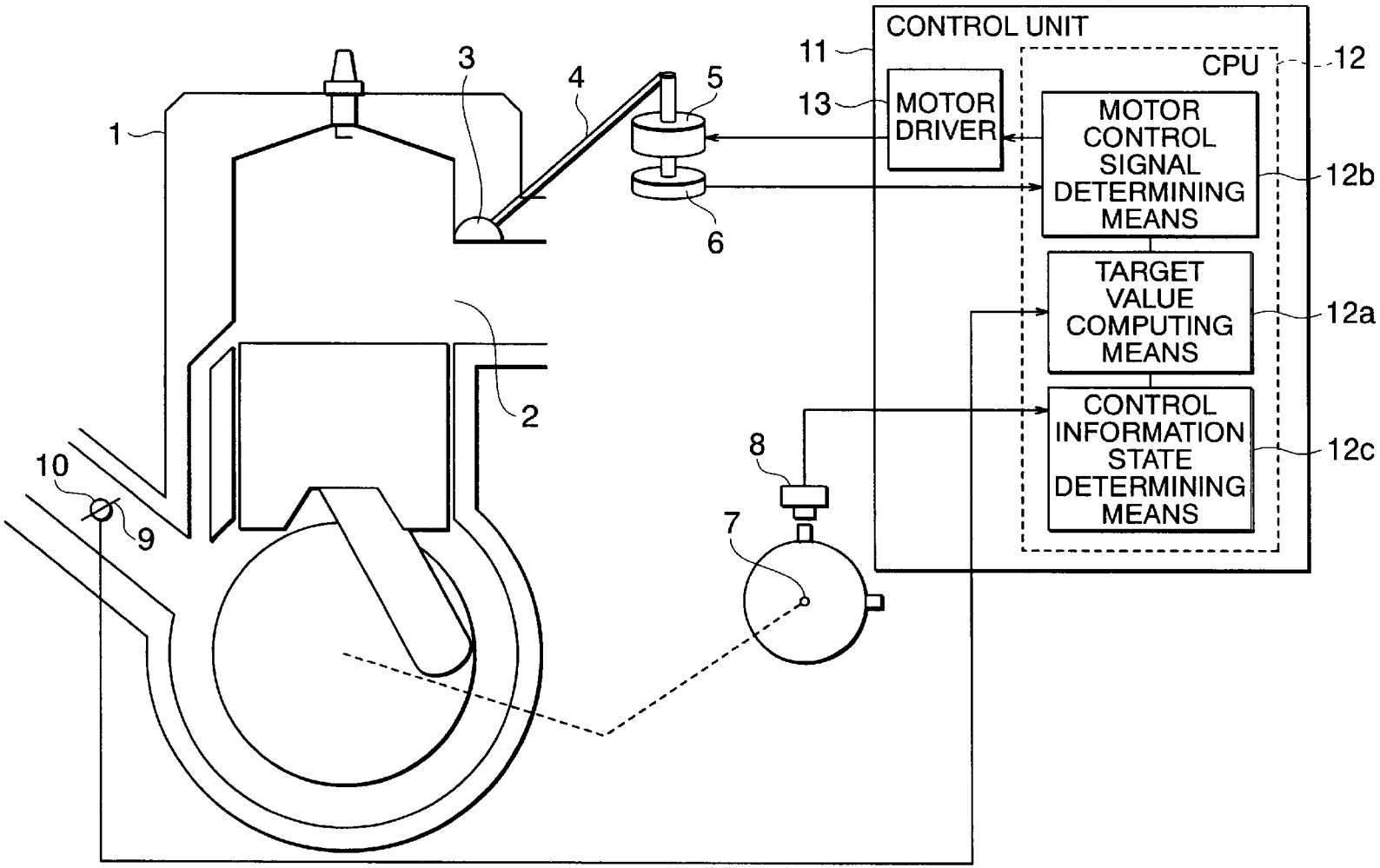
FIG. 1 is a diagram of an overall construction of a control device for controlling a control motor of an internal combustion engine, according to an embodiment of the present invention.

Explanation will now be made of an embodiment of the present invention. FIG. 1 is a diagram showing an overall construction of a control device for a control motor of an internal combustion engine in accordance with this embodiment. In FIG. 1, reference numeral 1 refers to an engine, reference numeral 2 refers to an exhaust port, reference numeral 3 refers to an exhaust valve, reference numeral 4 refers to a wire cable, reference numeral 5 refers to a control motor, reference numeral 6 refers to a potentiometer, reference numeral 7 refers to a crank shaft, reference numeral 8 refers to a rotation sensor, reference numeral 9 refers to a throttle valve, reference numeral 10 refers to a throttle position sensor, reference numeral 11 refers to a control unit, reference numeral 12 refers to a CPU, reference numeral 12*a* refers to a target value computing means, reference numeral 12*b* refers to a motor control signal determining means, reference numeral 12*c* refers to a control information state determining means, and reference numeral 13 refers to a motor driver.

As shown in FIG. 1, the engine 1 is a cycle engine, and the exhaust valve 3 is provided to the exhaust port 2. The exhaust valve 3 operates in association with the motor 5 by means of the wire cable 4. The motor 5 is installed with the potentiometer 6 serving as a current value detecting means, which detects the current rotational angle of the motor 5. Serving as an operational state detecting means, the crank shaft 7 is installed with the rotation sensor 8 which detects a signal indicating the rotational angle of the crank shaft, thereby detecting the rpm of the engine. The throttle valve 9 is installed with the throttle position sensor 10 which detects the opening degree at which the throttle is opened.

The control unit 11 includes the CPU 12, the motor driver 13 and the like. The CPU 12 is provided with the control information state determining means 12*c* for generating engine rpm state information which serves as control state information based on a change in an engine rpm from the rotation sensor 8; target value computing means 12*a* for computing the target opening degree of the exhaust valve 3 based on the engine rpm that was corrected with the engine rpm state information and based on the throttle opening degree information from the throttle position sensor 10; and motor control signal determining means 12*b* for controlling output of a motor control signal based on the target opening degree of the exhaust valve 3, current rotation angle information indicating the current rotation angle of the motor 5 from the potentiometer 6, and the engine rpm. The motor driver 13 is a driver for driving the motor 5, and it outputs a drive current to the motor 5 based on a motor control signal from the CPU 12.

Figure 2:
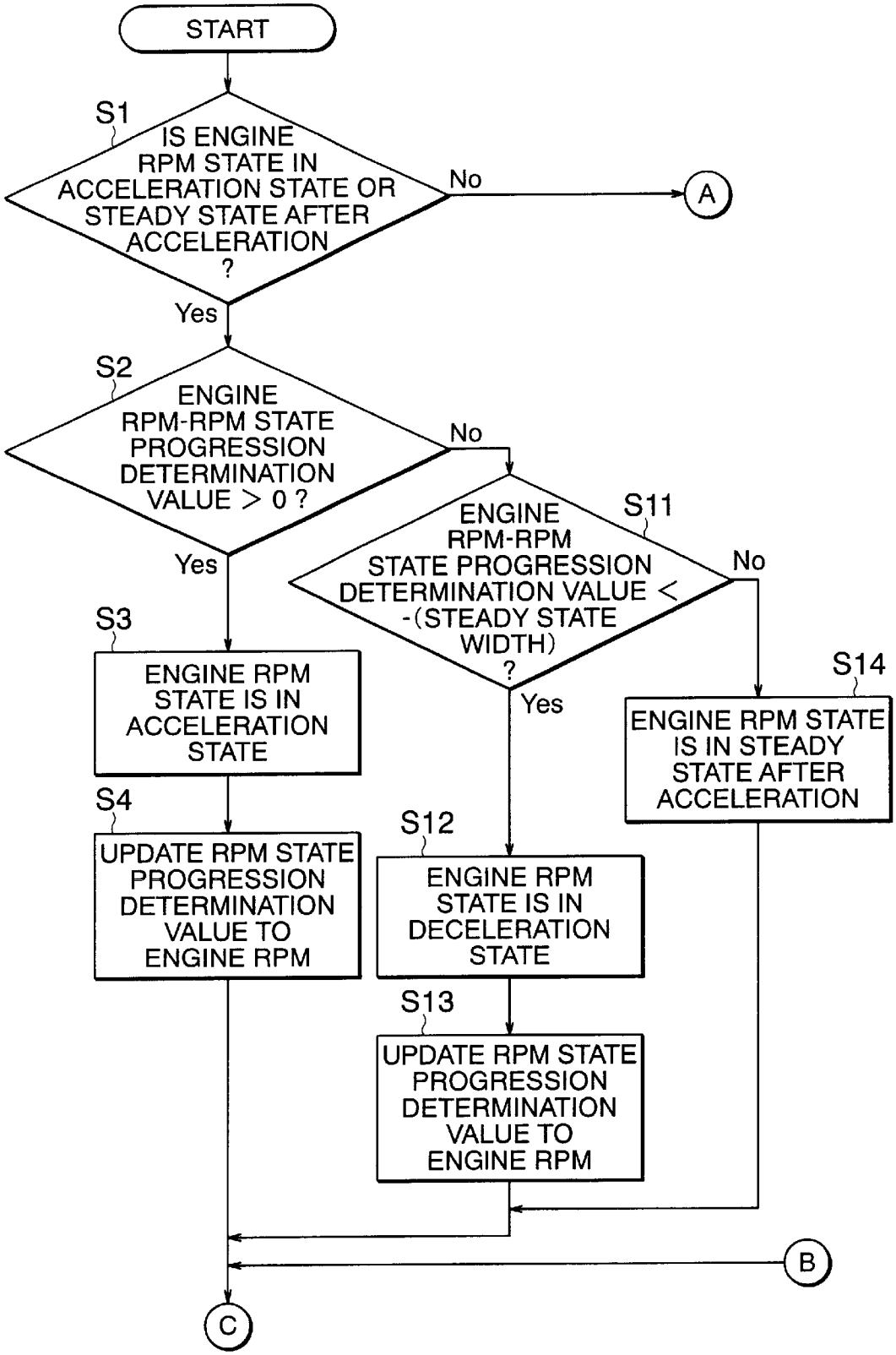
FIG. 2 is a flow chart showing operations of a control device for controlling a control motor of an internal combustion engine according to the present invention.
Figure 3:
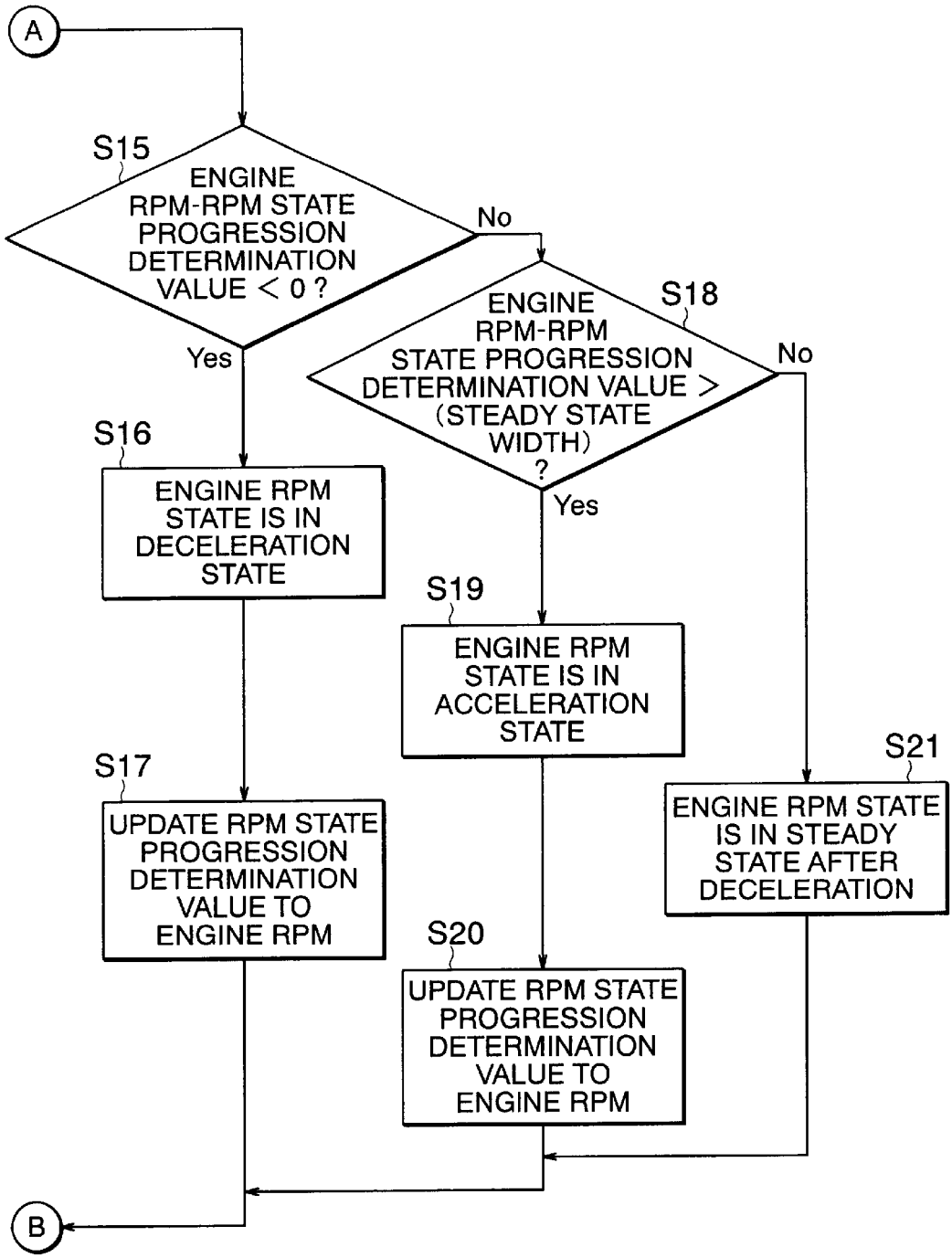
FIG. 3 is a flow chart showing operations of the control device for controlling the control motor of the internal combustion engine according to the present invention.
Figure 4:
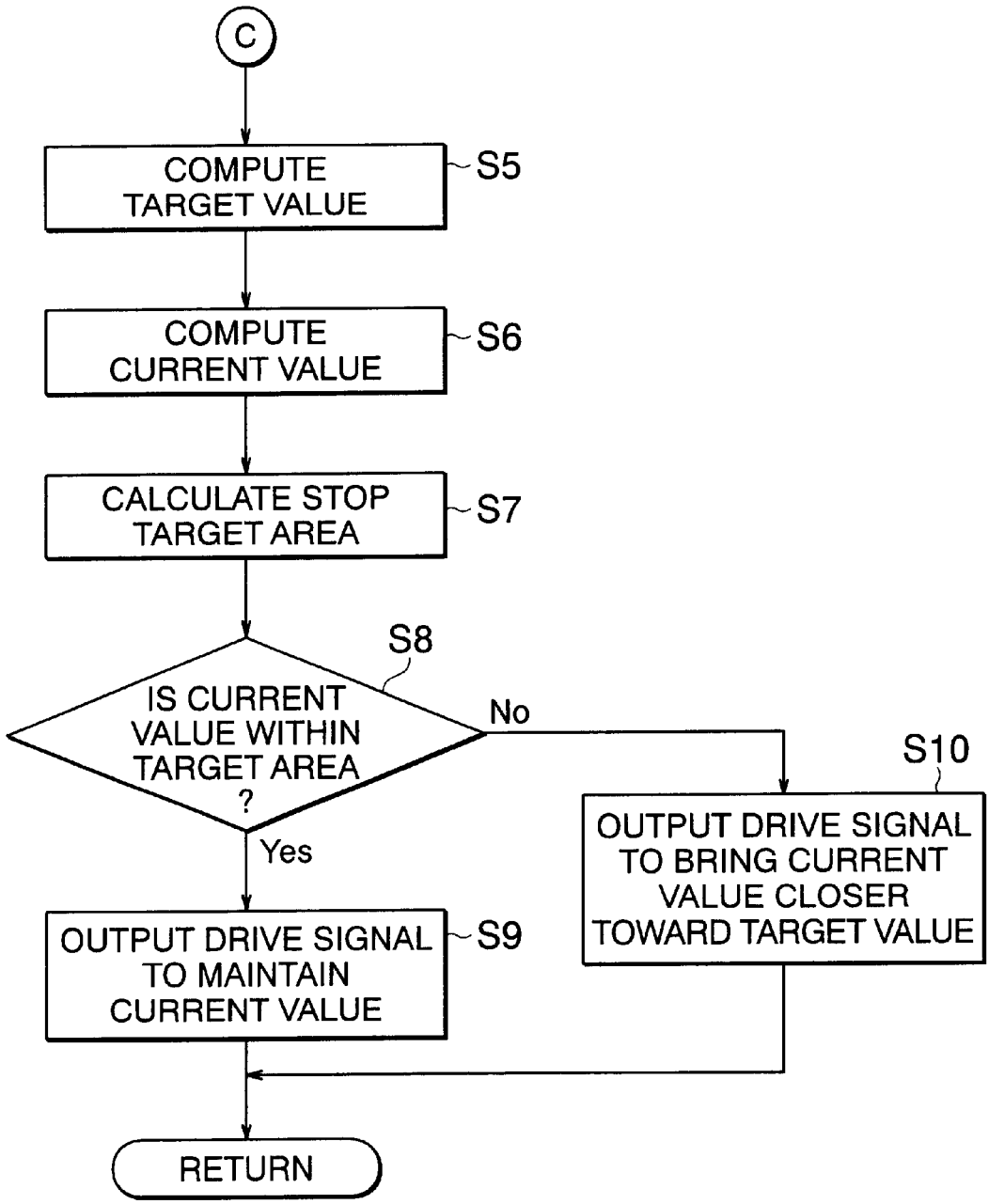
FIG. 4 is a flow chart showing operations of the control device for controlling the control motor of the internal combustion engine according to the present invention.
Figure 5:
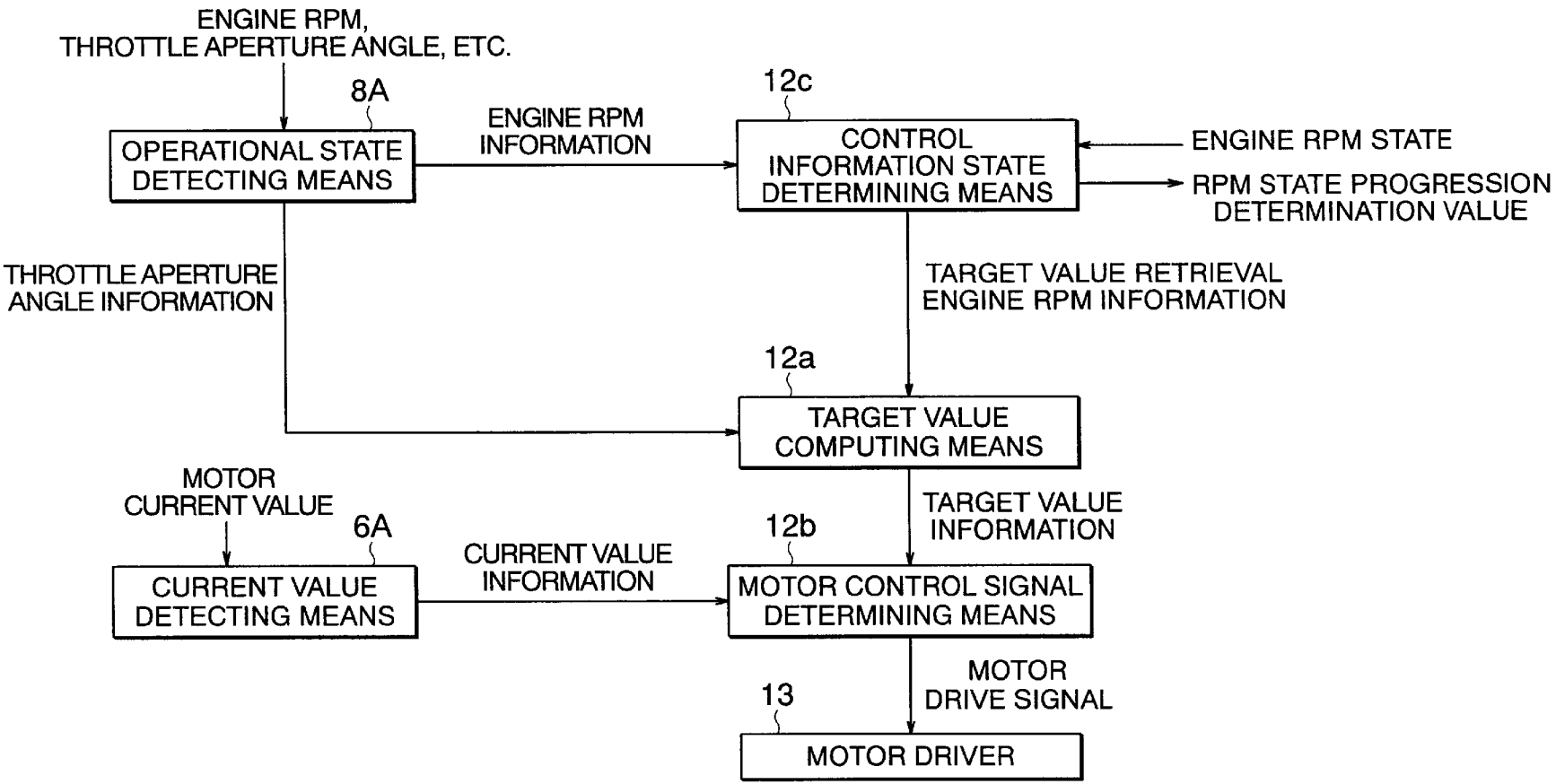
FIG. 5 is an explanatory diagram illustrating a flow of information in control operations in the control device for controlling the control motor of the internal combustion engine according to the present invention.
Figure 6:
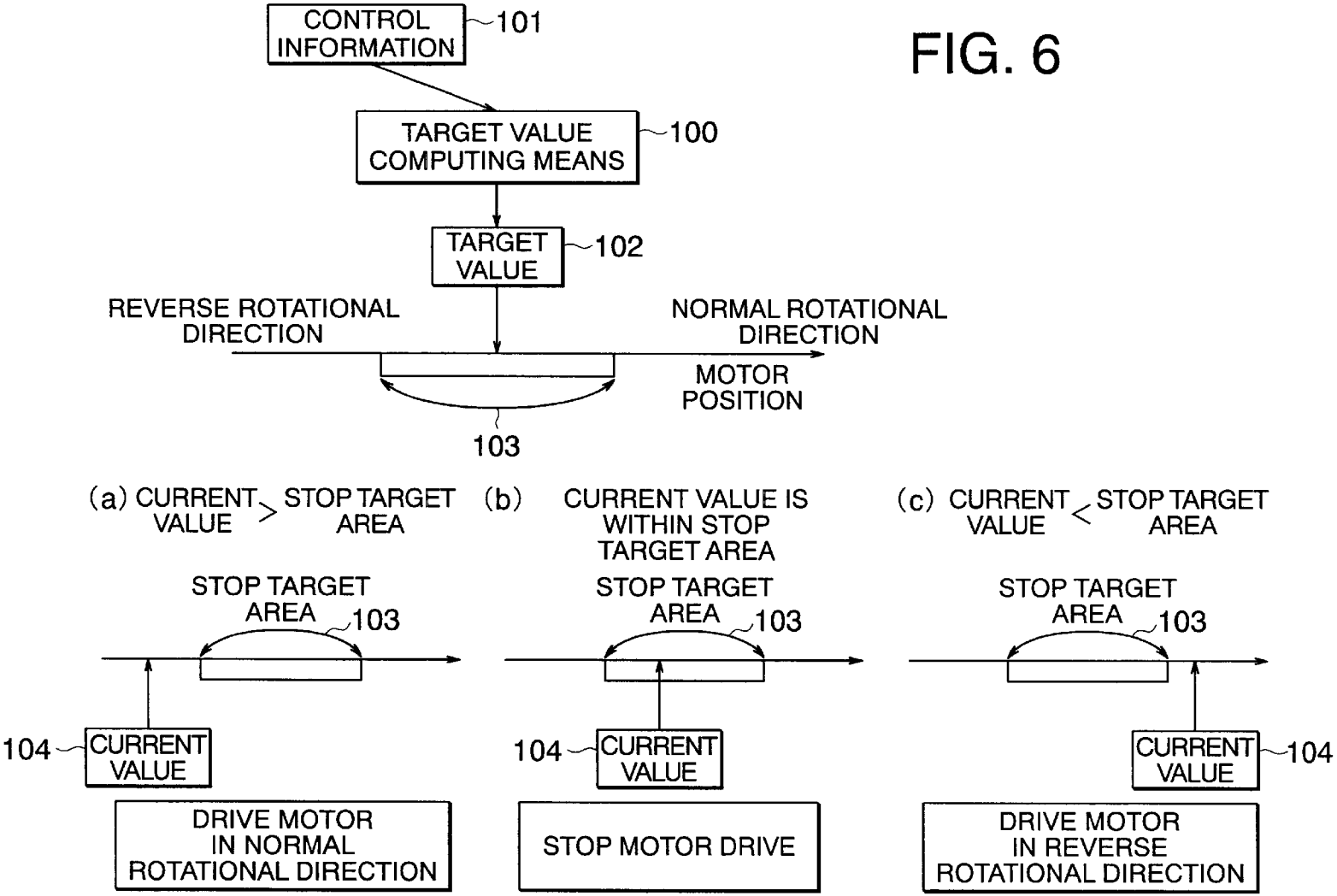
FIG. 6 is an explanatory diagram illustrating how the stop target area is obtained and a motor control performed based on a relationship between the stop target area and a current opening degree, in a conventional method for using a motor to control a control valve to follow a target opening degree.
Figure 7:
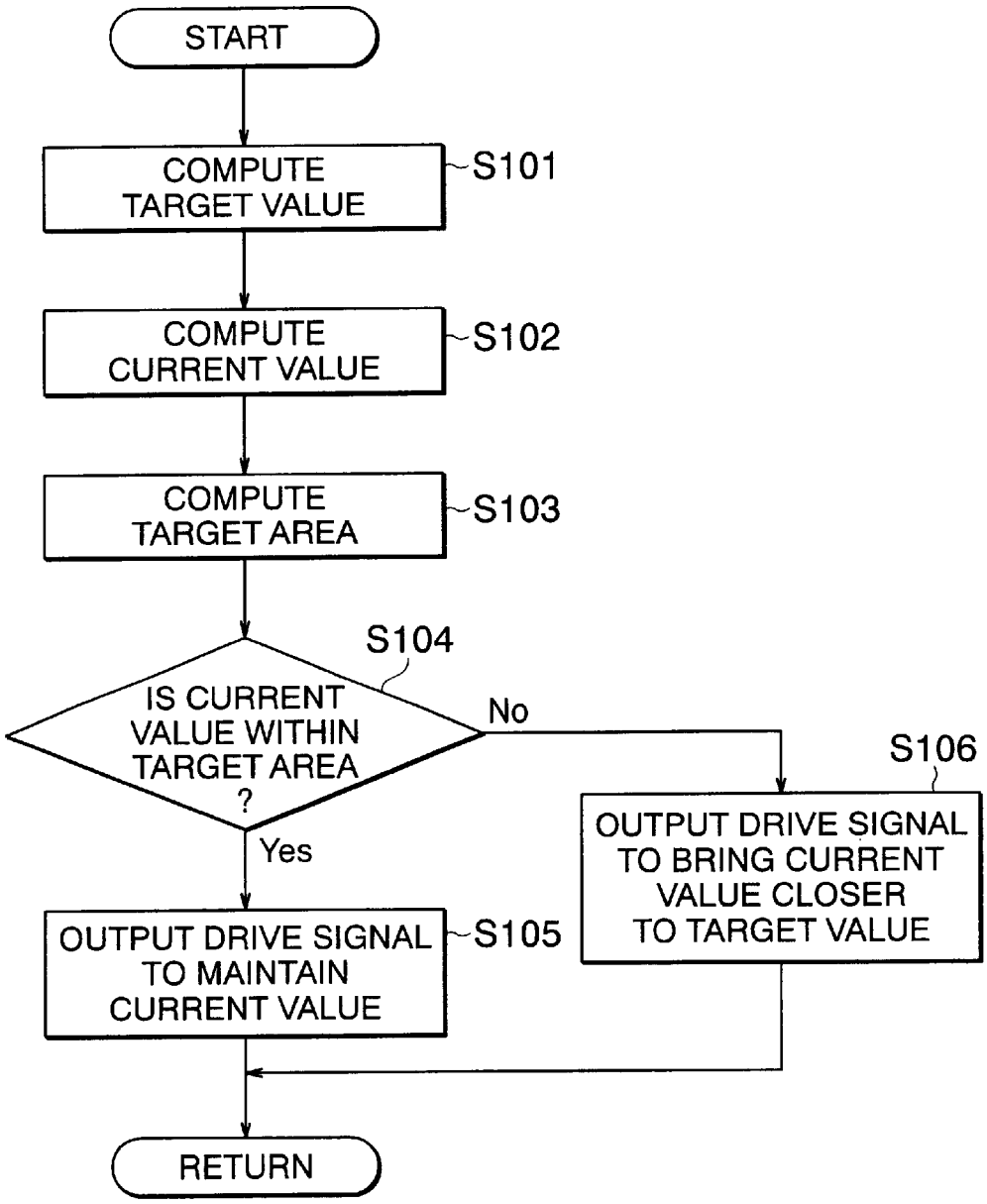
FIG. 7 is a flow chart of a the conventional method for using the motor to control the control valve to follow a stop target opening degree.
Figure 8:
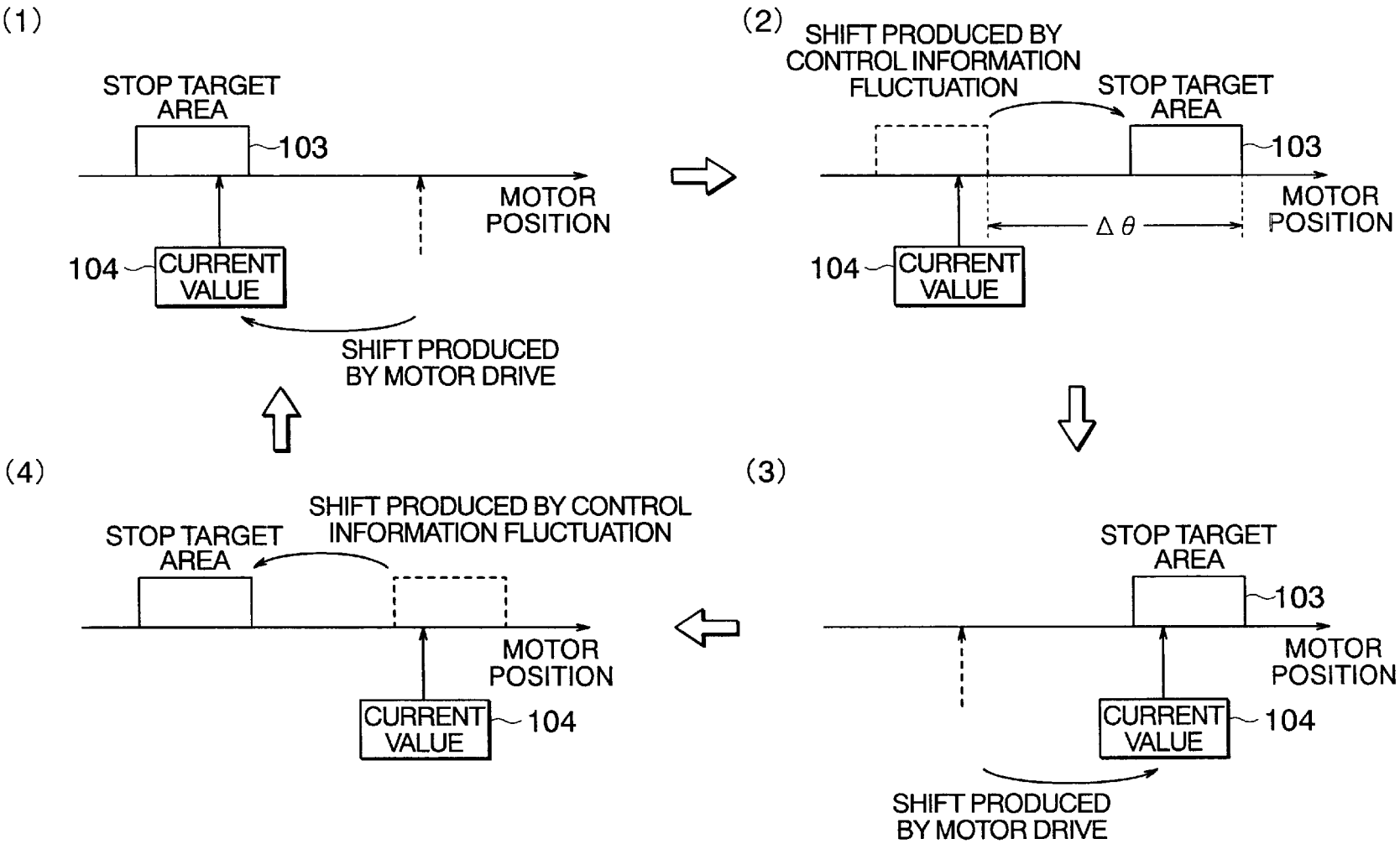
FIG. 8 is an explanatory diagram illustrating vibration in the current opening degree caused by a great fluctuation in a target opening degree, in the conventional method for using the motor to control the control valve to follow the stop target opening degree.

Next, explanation will now be made of operations according to this embodiment. FIGS. 2 to 4 are flow charts showing control operations according to the present invention. In accordance with this embodiment, the sequence of operations is repeated once per a given duration of time (for example, every 5 msec). FIG. 5 is a diagram showing a flow of information according to this embodiment.

First, using operational state detecting means 8A, the CPU 12 detects information about the operational state of the engine such as the engine rpm from the rotation sensor 8 and the throttle opening degree from the throttle position sensor 10. The engine rpm is given to the control information state determining means 12*c*. Then, the engine rpm state information (described below) which serves as the control state information, and a rpm state transition determining value (described below), by which the transition of the engine rpm state information is determined, are updated based on changes in the engine rpm. These are used to produce target value retrieval engine rpm information, which is a corrected control information.

The engine rpm state has four states: an acceleration state, a deceleration state, a steady state after acceleration, and a steady state after deceleration. The transition of the engine rpm state is determined using the difference between the engine rpm information and the rpm state transition determining value and a current engine rpm state.

As shown in FIGS. 2–4, when the engine rpm state is in the acceleration state or in the steady state after acceleration (step S1), if the difference between the engine rpm information and the rpm state transition determination value is larger than a steady state width area having the rpm state transition determination value as its upper limit value, then the engine rpm state is updated to the acceleration state (step S3); if it is less than the above-mentioned area (step S11), then the engine rpm state is updated to the deceleration state (step S12); and if it falls within the area, then the engine rpm state is updated to the steady state after acceleration (step S14). At step S1, when the engine rpm state is in the deceleration state or in the steady state after deceleration, if the difference between the engine rpm information and the rpm state transition determination value (step s15) is greater than a steady state width area having the rpm state transition determination value as its lower limit value (step S18), then the engine rpm state is updated to the acceleration state (step S19); if it is less than the above-mentioned area, then the engine rpm state is updated to the deceleration state (step S16); and if it falls within the area, then the engine rpm state is updated to the steady state after deceleration (step S21). When the engine rpm state is updated, in the case where it was the acceleration state (steps S3, S19) or the deceleration state (steps S12, S16), the rpm state transition determination value is updated to the engine rpm (steps S4, S20, S13 and S17). The target value retrieval engine rpm information is the value produced when the rpm state transition determination value is corrected using the engine rpm state. The rpm state transition determination value is a fixed value as long as the steady state after acceleration and the steady state after deceleration are continued. Therefore, when the engine rpm continues to fluctuate within a range that is narrower than the width of the steady state, the target-value-retrieval engine-rpm-information will be a fixed value. The target opening degree corresponding to the target value retrieval engine rpm information is determined (step S5), and the current value is detected by the potentiometer 6 acting as the current value detecting means (step S6), and thus the stop target area is determined (step S7). Next, the motor control signal determining means 12*b* compares the current value against the stop target area (step 8), to thereby control the output of the motor control signal. At step S8, in a case where the current value falls within the stop target area, the output of the motor control signal is determined so as to maintain the current value of the motor (step S9), and in a case where the current value is outside the stop target area the output is determined so as to bring the current value of the motor closer toward the stop target area (step S10). The motor driver 13 uses the motor control signal to output the drive current, to thereby drive the motor 5.

With this embodiment, the present invention is applied to the motor 5 for opening and closing the exhaust valve 3 which is furnished to an exhaust port 2, to alleviate the phenomenon of the motor vibration caused jointly by the setting of the target value and the fluctuation of the engine rpm. However, the present invention may also be used in the control of another motor such as a control valve motor for controlling the length of an intake pipe.

Also, in according to the present embodiment, the engine rpm or the throttle opening degree is used by the target value computing means as information of the operational state of the engine. However, in the present invention, other information such as a negative pressure of the intake pipe or an intake air temperature may also be used.

Further, in accordance with the present embodiment, the state of the engine rpm is determined and controlled by the control information state determining means; however, if the control information is used by the target value computing means to retrieve the target value, then other control information may also be used to determine the state and correct the control information.

As described above, in accordance with the present invention, the CPU 12 detects the control information with the operational state detecting means and updates the control state information based on the control information by using the control information state determining means, and the control information which has been corrected with the control state information is used by the target value computing means to compute the target value to determine the stop target area. Also, the current value is detected by the potentiometer which serves as the current value detecting means, the current value and the stop target area are compared against each other to control the output of the motor control signal, and the motor driver 13 outputs a drive current with the motor control signal, whereby the motor 5 is driven. Therefore, even if the control information always fluctuates, such as in a case of the engine rpm, it is recognized that the control state information enables manipulations to be performed such that the control information is being maintained without changes. Further, by correcting the control information, which determines the target opening degree, so that the control information does not fluctuate when performing the manipulation to maintain the control information without changes, a phenomenon in which the motor vibrates can be alleviated and resolved, and thus the motor can be protected.

The present invention is a control device for controlling a control motor of an internal combustion engine which follows a target value that changes in response to an operational state of the internal combustion engine, the control device comprising: control information output means for detecting the operational state of the internal combustion engine and turning it into control information; target value computing means for obtaining the target value of the control motor as corresponding to the control information outputted from the control information output means; current value detecting means for detecting a current value of the control motor; motor control signal determining means for generating a motor control signal for controlling a drive of the control motor, based on the target value and on the current value; drive means for driving the control motor based on the motor control signal; and control state information determining means for generating control state information indicating a change in the operational state of the internal combustion engine, based on a change in the control information outputted from the control information output means; in which the target value computing means corrects the control information based on the control state information, and obtains the target value corresponding to the corrected control information, whereby it can be recognized that the control state information performs the manipulation such that the control information is maintained uniformly and it is possible to alleviate the phenomenon in which the motor vibrates by correcting the control information that determines the target value with the control state information.

Also, the control information has a characteristic of always fluctuating even in a case where operation is performed so as to uniformly maintain the operational state of the internal combustion engine. Thus, there arose the phenomenon in which the motor vibrated conventionally. However, the target value can be determined based on the control information corrected by the control state information, whereby the phenomenon in which the motor vibrates can be alleviated.

Also, one of the control information is an engine rpm, and the control state information determining means generates the control state information based on a change in the engine rpm, whereby it is possible to alleviate the phenomenon in which the motor vibrates due to the combination of the setting of the target value and the fluctuations of the engine rpm.

Also, the internal combustion engine is a 2-stroke engine, and the control motor operates an exhaust valve provided to an exhaust port, whereby it is possible to alleviate the phenomenon in which the motor vibrates due to the combination of the setting of the target value and the fluctuations of the engine rpm.

What is claimed is:

1. A control device for controlling a control motor of an internal combustion engine which follows a target value that changes in response to an operational state of the internal combustion engine, the control device comprising:

control information output means for detecting the operational state of the internal combustion engine and turning it into control information;

target value computing means for obtaining the target value of the control motor corresponding to the control information outputted from the control information output means;

current value detecting means for detecting a current value of the control motor;

motor control signal determining means for generating a motor control signal for controlling a drive of the control motor, based on the target value and on the current value;

drive means for driving the control motor based on the motor control signal; and control state information determining means for generating control state information indicating a change in the operational state of the internal combustion engine, based on a change in the control information outputted from the control information output means;

wherein the target value computing means corrects the control information based on the control state information, and obtains the target value corresponding to the corrected control information; and wherein the internal combustion engine is in one of four operational states, the four operational states being an acceleration state, a steady state after acceleration, a deceleration state, and a steady state after deceleration, and wherein the control state information determining means identifies the state of the internal combustion engine so as to generate the control state information.

2. A control device for controlling a control motor of an internal combustion engine according to claim 1, wherein the control information has a characteristic of always fluctuating even in a case where operation is performed so as to uniformly maintain the operational state of the internal combustion engine.

3. A control device for controlling a control motor of an internal combustion engine according to claim 1, wherein: one of the control information is an engine rpm; and the control state information determining means generates the control state information based on a change in the engine rpm.

4. A control device for controlling a control motor of an internal combustion engine according to claim 2, wherein: one of the control information is an engine rpm; and the control state information determining means generates the control state information based on a change in the engine rpm.

5. A control device for controlling a control motor of an internal combustion engine according to claim 1, wherein the internal combustion engine is a 2-stroke engine; and the control motor operates an exhaust valve provided to an exhaust port.

6. A control device for controlling a control motor of an internal combustion engine according to claim 2, wherein the internal combustion engine is a 2-stroke engine; and the control motor operates an exhaust valve provided to an exhaust port.

7. A control device for controlling a control motor of an internal combustion engine according to claim 3, wherein the internal combustion engine is a 2-stroke engine; and the control motor operates an exhaust valve provided to an exhaust port.

8. A control device for controlling a control motor of an internal combustion engine according to claim 4, wherein the internal combustion engine is a 2-stroke engine; and the control motor operates an exhaust valve provided to an exhaust port.

9. A method of controlling a control motor of an internal combustion engine which follows a target value that changes in response to an operational state of the internal combustion engine, comprising:

a) determining which of a plurality of states the internal combustion engine is in, if the engine is in an acceleration state or in a steady state after acceleration, determining the difference between a current rpm and an rpm state progression determination value, if the difference between said current rpm and said rpm state progression determination value is greater than 0, updating said engine state to an acceleration state, updating said rpm state progression determination value to said current rpm, and proceeding to step (b)

if the difference between said current rpm and said rpm state progression determination value is less than a steady state width, updating said engine state to a deceleration state, updating said rpm state progression determination value to engine rpm, and proceeding to step (b)

if the difference between said current rpm and said rpm state progression determination value is within said steady state width, proceeding to step (b);

b) computing a target value;

c) computing a current value;

d) calculating a stop target area;

e) determining if said current value is within said stop target area, if said current value is within said stop target area, outputting a drive signal to maintain said current value, if said current value is not within said stop target area, outputting a drive signal to bring said current value closer to said target value.

10. The method according to claim 9, wherein said determining of which of a plurality of states the internal combustion engine is in is based on a change in the rpm of the internal combustion engine.

11. The method according to claim 9, wherein:

said internal combustion engine is a 2-stroke engine; and wherein said current value comprises a state of an exhaust valve provided to an exhaust port.

12. A control device for controlling a control motor of an internal combustion engine which follows a target value that changes in response to an operational state of the internal combustion engine comprising:

a control unit operable to:

a) determine which of a plurality of states the internal combustion engine is in, if the engine is in an acceleration state or in a steady state after acceleration, determine the difference between a current rpm and an rpm state progression determination value, if the difference between said current rpm and said rpm state progression determination value is greater than 0, update said engine state to an acceleration state, update said rpm state progression determination value to said current rpm, and proceed to step (b), if the difference between said current rpm and said rpm state progression determination value is less than a steady state width, update said engine state to a deceleration state, update said rpm state progression determination value to engine rpm, and proceed to step (b), if the difference between said current rpm and said rpm state progression determination value is within said steady state width, proceed to step (b), b) compute a target value, c) compute a current value, d) calculate a stop target area, e) determine if said current value is within said stop target area, if said current value is within said stop target area, output a drive signal to maintain said current value, if said current value is not within said stop target area, output a drive signal to bring said current value closer to said target value.

13. The control device according to claim 12, wherein said control unit determines which of a plurality of states the internal combustion engine is in based on a change in the rpm of the internal combustion engine.

14. The control device according to claim 12, wherein:

said internal combustion engine is a 2-stroke engine; and wherein said current value comprises a state of an exhaust valve provided to an exhaust port.

* * * * *